US006421298B1

(12) United States Patent
Beattie et al.

(10) Patent No.: US 6,421,298 B1
(45) Date of Patent: Jul. 16, 2002

(54) MUD PULSE TELEMETRY

(75) Inventors: Mark S. Beattie, Katy; Ali H. Abdallah, Houston, both of TX (US)

(73) Assignee: Halliburton Energy Services, Houston, TX (US)

( * ) Notice: Subject to any disclaimer, the term of this patent is extended or adjusted under 35 U.S.C. 154(b) by 0 days.

(21) Appl. No.: 09/415,592

(22) Filed: Oct. 8, 1999

(51) Int. Cl.[7] ..... H04H 9/00
(52) U.S. Cl. ..... 367/83; 340/853.2; 340/855.4
(58) Field of Search ..... 367/83; 340/853.2, 340/855.4; 73/152.51, 152.52; 175/40, 48

(56) References Cited

U.S. PATENT DOCUMENTS 3,488,629 A * 1/1970 Claycomb ..... 367/83
3,716,830 A * 2/1973 Garcia ..... 367/83
3,742,443 A * 6/1973 Foster et al. ..... 367/83
3,747,059 A * 7/1973 Garcia ..... 367/83
4,590,593 A 5/1986 Rodney ..... 367/83
5,515,336 A 5/1996 Chin ..... 367/83
5,969,638 A 10/1999 Chin ..... 340/855.3

* cited by examiner

*Primary Examiner*—Timothy Edwards, Jr.
(74) *Attorney, Agent, or Firm*—Conley, Rose & Tayon; Mark E. Scott

(57) ABSTRACT

A method and related system for detecting mud pulse telemetry by measuring pressure fluctuations in drilling fluid by measuring mud pressure pulses at two locations. A first location is somewhat downstream of the mud pump and desurger and a second location is proximate to the mud pump and desurger. Given these two pressure signals they are subtracted to create a difference signal where the presence or absence of mud pressure pulses is determined by pressure spikes caused by the interaction of mud pressure pulses. A second method measures the mud pressure pulse at only one location.

31 Claims, 4 Drawing Sheets

MUD PULSE TELEMETRY

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates generally to measurement while drilling and logging while drilling technologies. More specifically, the invention relates to detecting telemetry from downhole sensors in a drilling operation by analyzing interaction patterns between pressure pulses. Drilling engineers have ordinary skill in this art.

2. Description of the Related Art

Modern petroleum drilling and production operations demand a great quantity of information relating to parameters and conditions downhole. Such information typically includes characteristics of the earth formations traversed by the wellbore, in addition to data relating to the size and configuration of the borehole itself. The collection of information relating to conditions downhole commonly is referred to as "logging." Logging has been known in the industry for many years as a technique for providing information regarding the particular earth formation being drilled and can be performed by several methods. In conventional oil well wireline logging, a probe is lowered into the borehole after some or all of the well has been drilled, and is used to determine certain characteristics of the formations traversed by the borehole.

Wireline logging is useful in assimilating information relating to formations downhole but it has certain disadvantages. For example, before the wireline logging tool can be run in the wellbore, the drillstring and bottomhole assembly must first be removed, or tripped, from the borehole, resulting in considerable cost and loss of drilling time for the driller (who typically is paying daily fees for the rental of drilling equipment). In addition, because wireline tools are unable to collect data during the actual drilling operation, drillers possibly must make decisions (such as the direction to drill, etc.) without sufficient information, or else incur the cost of tripping the drillstring to run a logging tool to gather more information relating to conditions downhole. In addition, because wireline logging occurs a relatively long period after the wellbore is drilled, the accuracy of the wireline measurement can be questionable. As one skilled in the art will understand, wellbore conditions tend to degrade as drilling fluids invade the formation in the vicinity of the wellbore. Additionally, the borehole shape may begin to degrade, reducing the accuracy of the measurements.

Because of the limitations associated with wireline logging, there recently has been an increasing emphasis on the collection of data during the drilling process itself. By collecting and processing data during the drilling process, without the necessity of tripping the drilling assembly to insert a wireline logging tool, the driller can make accurate modifications or corrections "real-time", as necessary, to optimize drilling performance. For example, the driller may change the weight-on-bit to cause the bottomhole assembly to tend to drill in a particular direction. Moreover, the measurement of formation parameters during drilling, and hopefully before invasion of the formation by the drilling fluid, increases the usefulness of the measured data. Further, making formation and borehole measurements during drilling can save the additional rig time which otherwise would be required to run a wireline logging tool.

Techniques for measuring conditions downhole, and the movement and location of the drilling assembly contemporaneously with the drilling of the well, have come to be known as "measurement-while-drilling" techniques, or "MWD." Similar techniques, concentrating more on the measurement of formation parameters of the type associated with wireline tools, commonly have been referred to as "logging while drilling" techniques, or "LWD." While distinctions between MWD and LWD may exist, the terms MWD and LWD are often used interchangeably. For the purposes of this disclosure, the term LWD will be used with the understanding that the term encompasses both the collection of formation parameters and the collection of information relating to the position of the drilling assembly while the bottomhole assembly is in the well. The measurement of formation properties during drilling of the well by LWD systems improves the timeliness of measurement data and, consequently, increases the efficiency of drilling operations. Typically, LWD measurements are used to provide information regarding the particular formation in which the borehole is traversing.

Referring to FIG. 1, there is illustrated an MWD system. A well bore or borehole 54 contains a drillstring or drill pipe 36 which includes a hollow center region, and defines an annulus 44 (the region between the outside of the drill string and periphery of the borehole). Also shown are stand pipe 34, drill bit 42, and transmitter 40. Stand pipe 34 connects above the earth's surface (or rig floor) 58 to desurger 26, pressure transducer 60, signal processor 62 (through a transmission line 50), mud pump 24 and drillstring 36. Drill bit 42 attaches to drillstring 36 at the lower end of the drillstring. Transmitter 40, part of a bottomhole assembly (not shown in its entirety), is located near the bottom of the drillstring, proximate to drill bit 42.

Typically, a pit at the surface of the earth (not shown) contains drilling fluid or mud. Mud pump 24 forces the drilling fluid into the drillstring, where it flows in a downstream direction as indicated by arrow T. Eventually, it exits the drillstring via ports in the drill bit 42 and circulates upward via annulus 44. The drilling fluid thereby lubricates the bit and carries formation cuttings to the surface of the earth. The drilling fluid is returned to the pit for recirculation.

Transmitter or pulser 40 generates an information signal representative of measured downhole parameters. This information signal typically is a pressure pulse signal that travels along the mud column at the speed of sound. Pulsers are known and typically transmit at low data transmission rates around 1 bps. Other devices are known which are capable of creating the mud pressure pulses. For instance, a mud siren, which typically creates acoustic waves within the drilling fluid in a frequency range of 12 to 24 Hertz, could be modified to generate the drilling fluid pressure pulses this invention is designed to detect. Pressure transducer 60 receives the mud pressure pulse at an upstream location, such as at the surface of the earth and converts the pressure signals to electronic signals. Transducer 60 outputs the received waveform across communication path 50 to signal processor 62 which operates to process and decode the received signals.

In an ideal system, each and every mud pressure pulse created downhole would propagate upstream and be easily detected by a pressure transducer at the surface of the earth. However, drilling mud pressure fluctuates significantly and contains noise because of several drilling parameters. The primary sources of noise in the pressure signal comprise: (1) the mud pump; (2) torque noise; and (3) bit noise. Bit noise is created by vibration of the drill bit during the drilling operation. As the bit moves and vibrates, bit jets where the drilling fluid exhausts can be partially or momentarily restricted, creating a high frequency noise in the pressure signal. Torque noise is generated downhole by the action of the drill bit sticking in a formation, causing the drillstring to torque up. The subsequent release of the drill bit relieves the torque on the drilling string and generates a low frequency, high amplitude pressure surge. Finally, the mud pumps themselves create cyclic noise as the pistons within the mud pump force the drilling mud into the drillstring.

Most drilling systems contain a dampener or desurger 26. The desurger is fluidly connected to the high pressure drilling mud on a drilling mud side 32. The desurger further has a gas or nitrogen side 28 which is separated from the mud side by diaphragm or separation membrane 30. The purpose of the desurger is to reduce noise levels generated by the mud pump 24. Manufactures of desurgers generally recommend the nitrogen side 28 pressure be filled to be approximately 50 to 75% of the operating pressure of the drilling mud. By expansion and contraction of the separation diaphragm 30, the desurger 26 has a variable volume or capacity which tends to absorb mud pressure increases and lessen mud pressure decreases. Though the desurger may reduce noise levels from the pump, significant noise can still be present which yields a poor signal to noise ratio in the detection of pulses created by the pulser downhole. Further, the pulsation dampener is a primary source of signal distortion of mud pressure pulses since the dampener tends to smooth these pulses in the same manner as it does the pressure surges from the mud pump. When high mud pressure pulse rates are used, a pressure buildup in the pipe occurs and the smoothed pulses become even more difficult to identify. Also, the desurgers signal reflective properties are most prevalent when operating in the recommended nitrogen pressure ranges.

Referring to FIG. 2*a,* there is depicted an idealized series of mud pressure pulses. For illustrative purposes, the time periods between successive pulses is shortened representing higher data rates. FIG. 2*b* depicts the effect the desurger might have upon the mud pressure pulses of FIG. 2*a* showing two related phenomena. First, the desurger tends to smooth the sharp rising and falling edges of the mud pressure pulses, similar to the way in which a capacitor might smooth an electrical signal in an electrical circuit. Second, as the pulse rate increases and the subsequent time between pulses decreases, the dampening effect only allows for a partial settling of the pressure before a subsequent mud pressure pulse arrives and therefore a general increase in pressure occurs with a corresponding decrease in detected pulse amplitude. This combination of factors makes increased data rates hard to achieve because of the signal degradation caused by the dampening effect upon the mud pressure pulses as data rates increase.

In addition to noise not absorbed by the desurger and desurger dampening, related art devices have also had to contend with a problem of reflection of upstream traveling pulses from one, both or a combination of the desurger 26 and mud pump 24. What is needed is a mud pulse detection system which is not significantly affected by the presence of the reflected pulses or the smoothing effect of the desurger.

SUMMARY OF THE INVENTION

The present invention features two embodiments for detecting drilling fluid pressure pulses generated by downhole or downstream devices by analyzing interaction between upstream traveling drilling fluid pressure pulses and downstream traveling fluid pressure pulses created by reflection of upstream traveling fluid pressure pulses.

In the preferred embodiment, two transducers are used to detect pressure pulses downstream from reflective elements being one or both of a desurger and/or mud pump. The first transducer is positioned such that a leading portion of the upstream traveling pulse is measured before interference of the upstream traveling pulse with a downstream traveling pulse. This location further provides that a trailing portion of the downstream traveling pulse is measured without interference from a trailing portion of the upstream traveling pulse. A second transducer in this embodiment is located as close as possible to the desurger. Inasmuch as the desurger and the mud pump form a reflective element, the fluid pressure pulse detected at this second location by the second transducer has the characteristic of being the almost instantaneous summation of the upstream traveling pulse and the downstream traveling pulse created by reflection of the upstream traveling pulse because the transducer is located so close to the reflective element. Given these two signals, one or both is time adjusted, and then the second measurement is subtracted from the first measurement to give a difference signal. It is within this difference signal that pressure spikes indicating leading and trailing edges of a fluid pressure pulse of the mud telemetry communication can be detected.

A second method comprises the use of one transducer located at the first transducer location of the preferred embodiment. By bandpass filtering the signal received at the transducer, it is possible to detect the presence and width of a mud pressure pulse sent from downhole by looking for those portions of a signal where: (1) the transducer detects the upstream traveling pulse before interference with the downstream traveling pulse; and (2) the transducer detects the downstream traveling pulse after the upstream traveling pulse has passed the physical location of the first transducer.

Thus, the present invention comprises a combination of features and advantages which enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

CATALOG OF THE ELEMENTS

Figure 1:
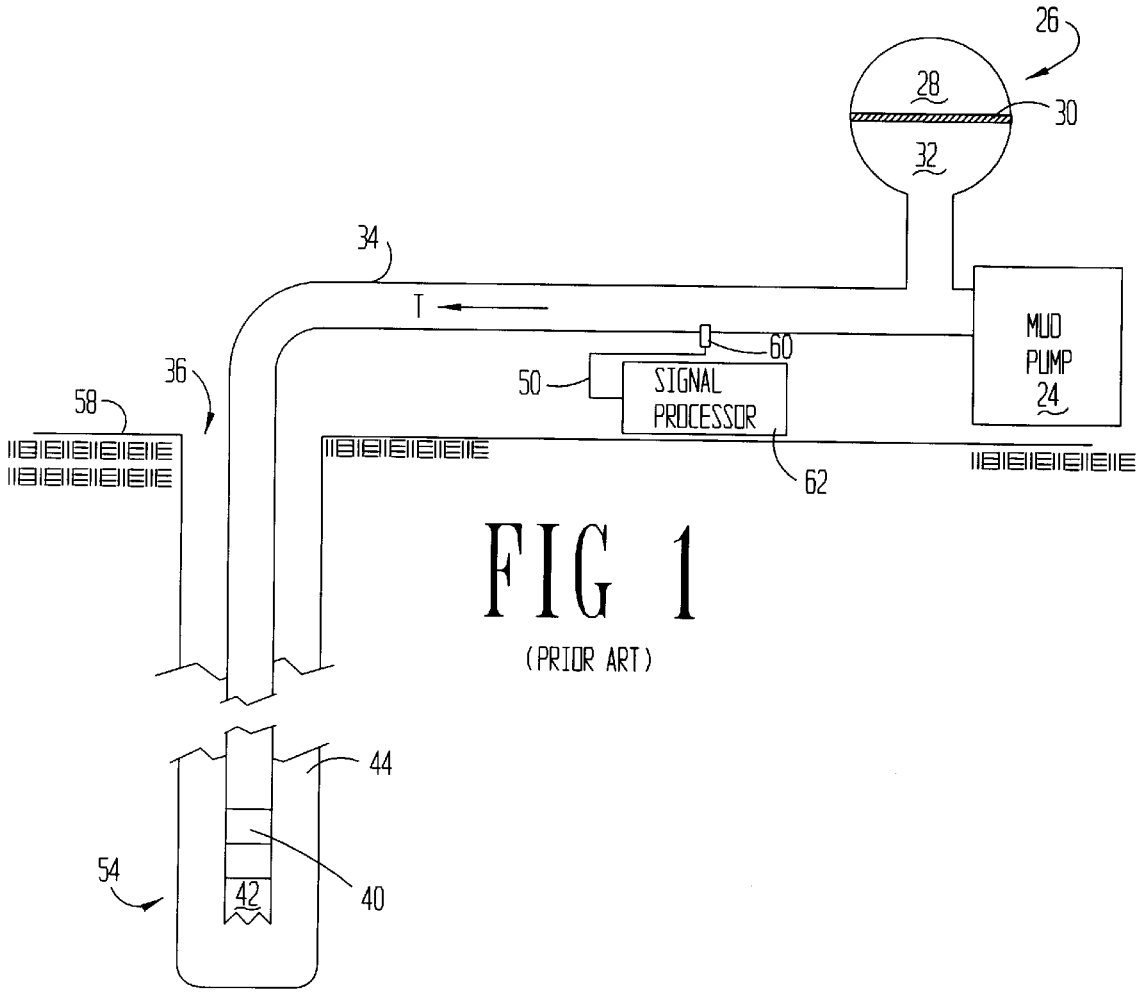
FIG 1 (PRIOR ART)
FIG. 1 is an LWD system describing the related art.

As an aid to correlating the terms of the claims to the exemplary drawing(s), the following catalog of elements and steps is provided:

A Pulse amplitude

B Intermediate pressure

P Time delay (Propagation Time)

T Direction of drilling mud travel

X Base line pressure

X1 Transducer location

10 Pipe

12 Upstream portion

14 Downstream portion

16 Upstream traveling mud pressure pulse

18 Downstream traveling mud pressure pulse

20 Positive pressure spike

22 Negative pressure spike

24 Mud pump

26 Desurger

28 Nitrogen side of desurger

30 Separation membrane

32 Drilling mud side of desurger

34 Stand pipe

36 Drill string

40 Transmitter or mud siren

42 Drill bit

44 Annulus

46 First transducer

48 Second transducer

50 Communication path

52 Communication path

54 Bore hole

56 Hollow center of the drill string

58 Earth's surface

60 Single transducer

62 Signal processor

64 Mud pump noise

DETAILED DESCRIPTION OF THE PREFERRED EMBODIMENT

During the course of the following description, the terms "upstream" and "downstream" are used to denote relative positions of certain components and directions of travel of mud pressure pulses with respect to direction of flow of drilling mud. Thus, where a term is described as upstream of another, it is intended to mean that the drilling mud flows through or past the first component before flowing through or past the second component. Also the term downhole may be used in this specification. The term downhole is a relative term meaning generally any location within the borehole below the surface of the earth; however, downhole as used herein will generally mean near the bottom of the borehole proximate to the drill bit 42.

Drilling Fluid Pressure Pulse Interaction

The key to understanding the present invention is an understanding of the characteristics and interaction of mud pressure pulses in a drilling system. Pressure pulses created downhole travel upstream with a definite speed. Depending on the fluid properties of the drilling mud, the speed of the pulse can range from about 3,200 feet per second to about 4,800 feet per second. Noise created when upstream traveling mud pressure pulses reflect to become downstream traveling pulses constructively or destructively interacts with the upstream traveling pulses.

Figure 3:
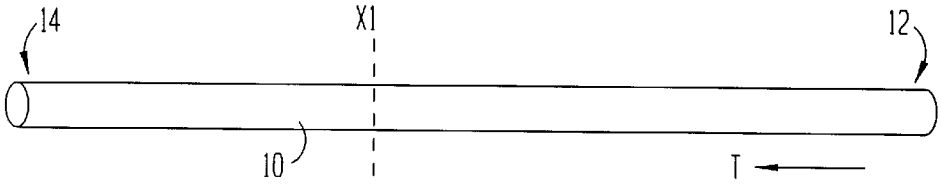
FIG. 3 is a view of a long pipe containing pressure pulses.
Figure 4:
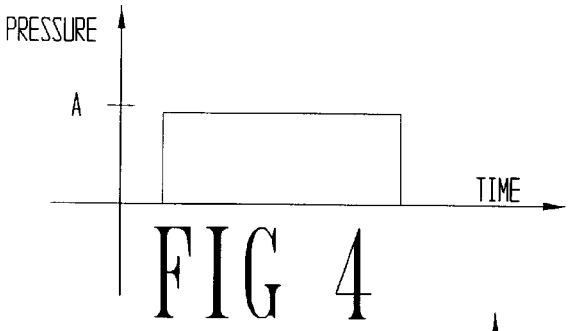
FIG. 4 is a plot of pressure within the pipe as a function of time given positive fluid pressure pulse.
Figure 5:
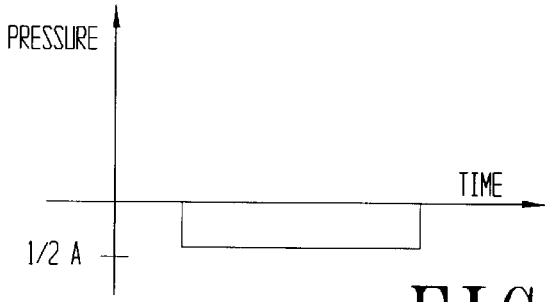
FIG. 5 is a plot of pressure within the pipe as a function of time given a negative fluid pressure pulse.

For the purpose of describing the interaction between upstream traveling pulses and downstream traveling pulses, reference is made to FIG. 3. FIG. 3 shows a long pipe 10 having an upstream portion 12, downstream portion 14 and containing drilling fluid moving from the upstream portion 12 to the downstream portion 14 in the direction indicated by T. A pressure transducer is located at the position X1 indicated with the dash line. A mud pressure pulse created in the downsteam 14 portion of the pipe 10 travels from the downstream portion 14 to the upstream portion 12. A transducer at location X1 detects the pressure pulse as the pulse traverses the location of the transmitter. FIG. 4 plots as a function of time the pressure read by a transducer at location X1 as an upstream traveling pulse passes location X1 and assuming the mud pressure pulse created is a perfect square wave with amplitude A. Assuming the mud pressure pulse traveling from the downstream 14 to upstream 12 has passed and dissipated, now assume a mud pressure pulse is created upstream 12 traveling downstream 14. Further assume the mud pressure pulse has a negative amplitude of one half of A. FIG. 5 shows a plot of the pressure read by a transducer at location X1 as this downstream traveling pressure pulse passes the transducer and again assuming the pulse created is a perfect square wave.

Figure 6:
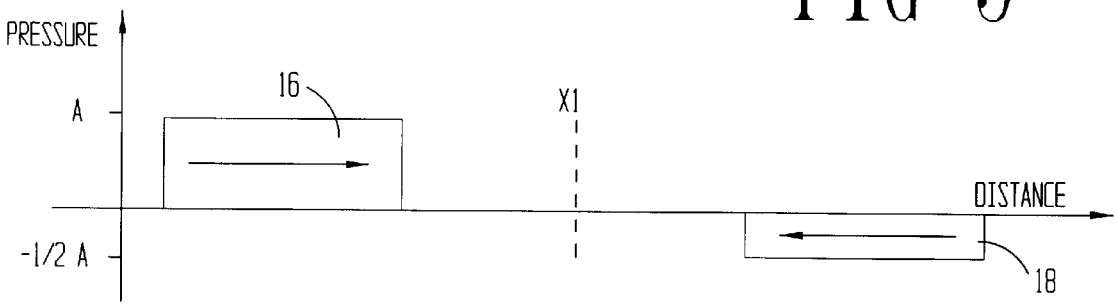
FIG. 6 is a plot of pressure within the pipe as a function of distance given specific oppositely traveling fluid pressure pulses.

To now describe the interaction of two waves traveling in opposite directions, assume, and still referring to FIG. 3, that two mud pressure pulses are created within the pipe 10. A first mud pressure pulse created at the downstream 14 end travels from the downstream 14 end to the upstream 12 end. Likewise, assume a second mud pressure pulse created at the upstream 12 end travels from the upstream 12 end to the downstream 14 end. Further assume the downstream traveling mud pressure pulse was created: (1) at exactly the same physical distance from the location X1 as the upstream traveling pulse; (2) the downstream traveling mud pressure pulse has a negative amplitude of about one-half the amplitude of the upstream traveling pulse; and (3) the downstream traveling mud pressure pulse was created a finite time P after the creation of the upstream traveling mud pressure pulse. Referring to FIG. 6, there is a plot of pressure within the pipe 10 as a function of location within the pipe some finite time after the creation of both mud pressure pulses but before either of the mud pressure pulses has traversed the location of transducer at X1. The direction of travel of each pulse is indicated by arrows within the mud pressure pulses represented in FIG. 6.

Figure 7:
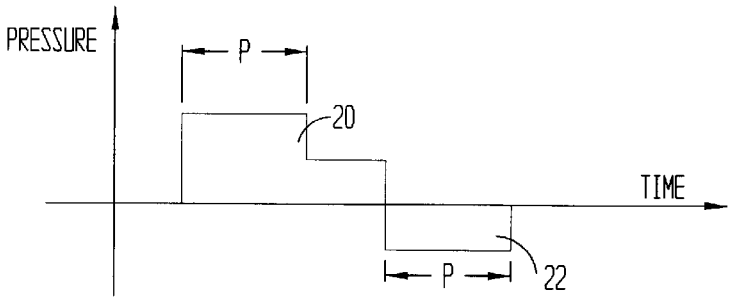
FIG. 7 is a plot of pressure detected within the pipe as a function of time as an upstream traveling pressure pulse and a downstream traveling pressure pulse traverse the same location.

The upstream traveling mud pressure pulse 16 and the downstream traveling mud pressure pulse 18 eventually traverse the transducer at location X1. Because it was assumed the downstream traveling mud pressure pulse 18 was created a finite time P after the creation of the upstream traveling mud pressure pulse 16, the upstream traveling pulse 16 reaches location X1 prior to the downstream traveling mud pressure pulse 18. The pressure indicated by a transducer at location X1 will be a summation of the amplitudes of the upstream traveling 16 and downstream traveling 18 mud pressure pulses as each pulse traverses the location X1. FIG. 7 graphs as a function of time the pressure indicated by a transducer located at position X1 given the two mud pressure pulses described.

The composite wave form of FIG. 7 represents the summation of the upstream traveling pulse 16 and the downstream traveling pulse 18 as each passes location X1. The positive pressure spike 20 and the negative pressure spike 22 each have a time width P. The positive pressure spike 20 represents a portion of the upstream traveling pulse 16 measured by the transducer at location X1 before the downstream traveling mud pressure pulse 18 has reached the same location. Likewise, the negative pressure spike 22 represents the pressure read by a transducer at location X1 when the upstream traveling mud pressure pulse 16 has completely traversed location X1 yet, because of the time delay P in creating the downstream traveling mud pressure pulse 18, the downstream pulse 18 traverses the location X1 for the amount of time P after the upstream traveling pulse 16 has passed.

Drilling Fluid Pressure Pulse Interaction in a Drilling System

Figure 8:
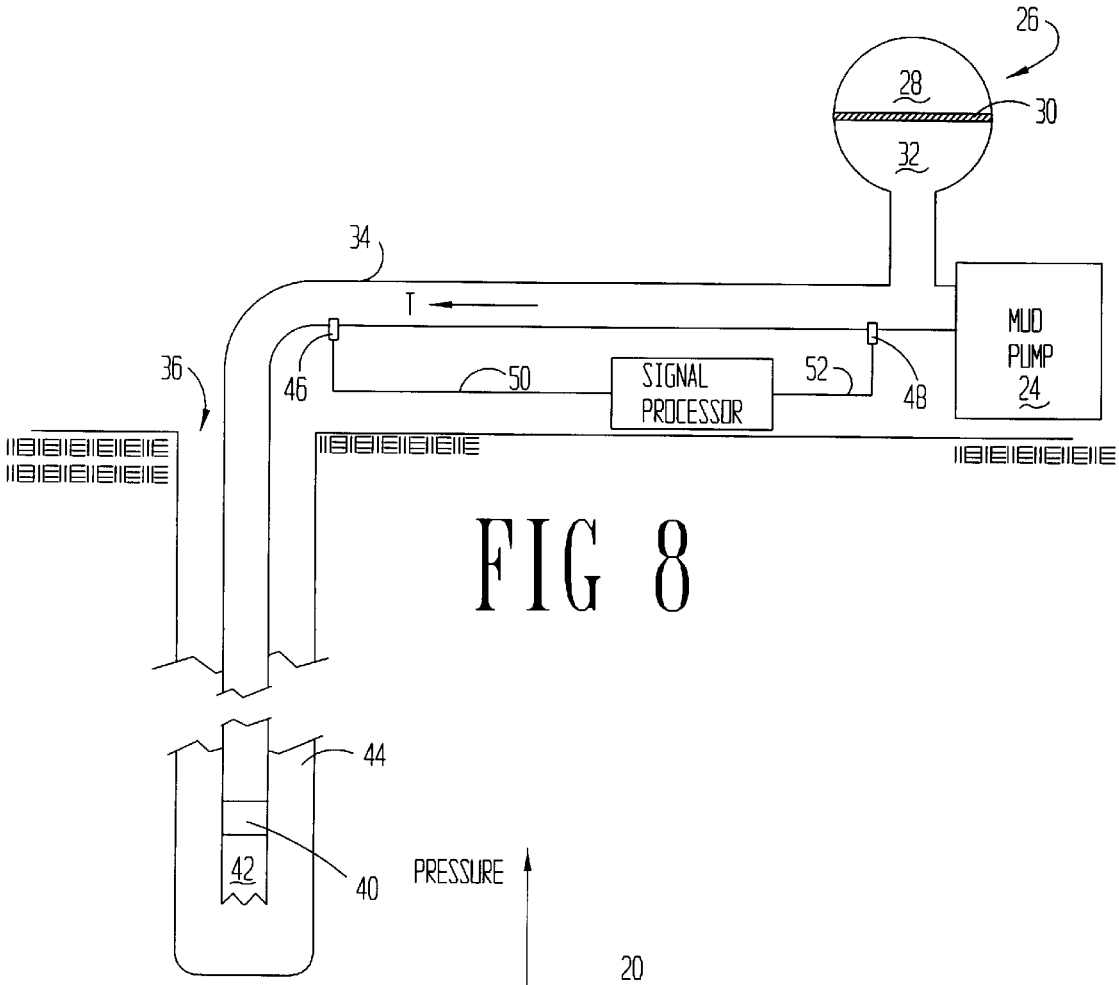
FIG. 8 is an LWD system showing the preferred embodiment.

The idealized interaction of propagating pulses described above is now described with reference to a drilling operation as shown in FIG. 8. As indicated in the figure, drilling mud moves from the mud pump 24 in the direction T within the standpipe 34. The standpipe 34 connects to the drillstring 36 and the drilling mud continues downhole through transmitter 40 to drill bit 42, then up through annulus 44. Sensors downhole send data to the surface by having the transmitter 40 create a series of mud pressure pulses which travel from the transmitter 40 upstream toward the mud pump 24 (each pulse of the series of pulses is roughly equivalent to pulse 16 of FIG. 4). As each mud pressure pulse travels upstream it propagates past transducer 46 and eventually impinges upon a reflective surface comprising one, both, or a combination of the mud pump 24 and desurger 26. The upstream traveling pulse is reflected off this surface to create a downstream traveling pressure pulse (this reflection pulse is roughly equivalent to pulse 18 of FIG. 4).

Figure 9:
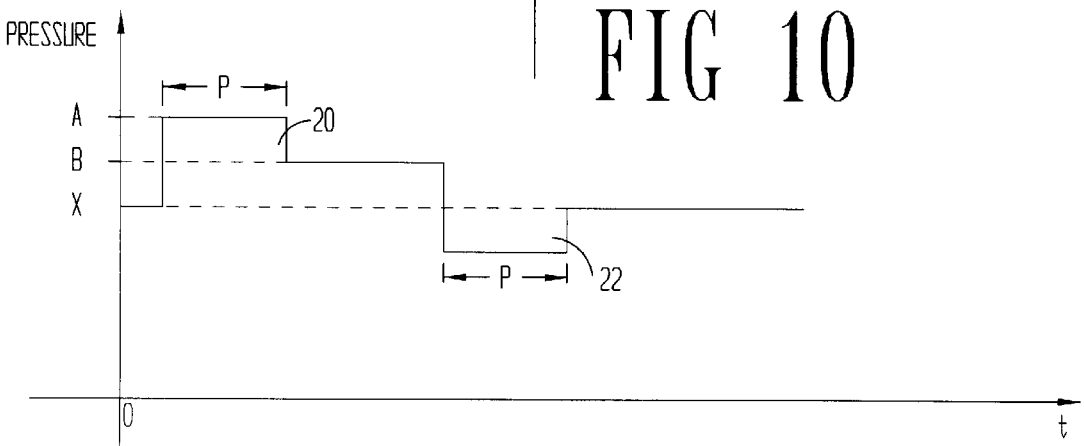
FIG. 9 shows an idealized wave form as detected by the first transducer in the preferred embodiment.

In the drilling system described in FIG. 8, transmitter 40 sends a series of mud pressure pulses. Each mud pressure pulse can represent, for example, one bit of data in the overall data stream sent from downhole to upstream sensors (depending upon the coding scheme). Other coding schemes could also be employed and the exact coding scheme selected is not crucial to the invention. With reference to a single mud pressure pulse, the transducer 40 creates the mud pressure pulse downhole. The mud pressure pulse created downhole travels upstream and takes a finite amount of time to reach transducer 46 based upon the depth of the drilling operation and characteristics of the drilling fluid. Assuming for explanatory purposes that the mud pressure pulse created by the transmitter 40 is a perfect square wave as it travels upstream within the drilling string, a transducer 46 placed sufficiently downstream of the mud pump and desurger detects a pressure change over time as indicated in FIG. 9. FIG. 9 indicates a base line pressure X which is a variable pressure that varies as a function of many parameters including drilling mud specific gravity and required downhole pressure. The exact base line pressure is not important to an understanding or operation of the invention. It must be understood however that mud pressure pulses created by downhole sensors 'ride' base line pressure, whatever that pressure happens to be. FIG. 9 further shows a pulse amplitude A which is the amount of pressure increase added to the base line pressure X representing the amplitude of the mud pressure pulse. The exact amplitude A of a mud pressure pulse created varies based on parameters of the drilling process. In a preferred embodiment, the pulse pressure amplitude will be approximately 10–50 pounds per square inch.

As the ideal square wave mud pressure pulse begins to traverse the location of transducer 46, the transducer initially reads the full amplitude of the mud pressure pulse. For an amount of time P, transducer 46 reads only a leading portion of the upstream traveling mud pressure pulse. This creates positive pressure spike 20. After the amount of time P, the pressure read by the transducer drops to an intermediate level B as indicated in FIG. 9. This drop to an intermediate pressure is caused by a destructive interaction of a reflected or downstream traveling pulse with the upstream traveling pulse. More specifically, the length of time P represents a propagation time for a leading portion of the upstream traveling pulse to reach the reflective elements of the drilling system, be reflected and travel back to the physical location of transducer 46. The reflective properties of the desurger are most prevalent when the nitrogen pressure of the desurger is within the manufacturer's suggested ranges. Because this invention utilizes this reflective property, desurger pressure is preferably operated in the manufacturer's suggested range; however, the method is operable outside the suggested range so long as sufficient reflections occur.

It has been found that the reflection of the upstream traveling pulse creates a downstream traveling pulse having a negative amplitude (a drop in pressure) and therefore the summation of the upstream traveling pulse and the downstream traveling pulse results in an intermediate pressure B for an amount of time when both the upstream traveling pulse and the downstream pulse are traversing the location of the transducer 46. As the trailing edge of the upstream traveling pulse completely traverses the location of transducer 46, a trailing portion of the downstream traveling pulse has yet to pass the location of the transmitter 46; therefore, the transducer 46 reads a drop in pressure below base line pressure X representing the amplitude of the downstream traveling pulse creating negative pressure spike 22. This drop in pressure is read until a trailing edge of the downstream traveling pulse passes the transducer 46.

Figure 10:
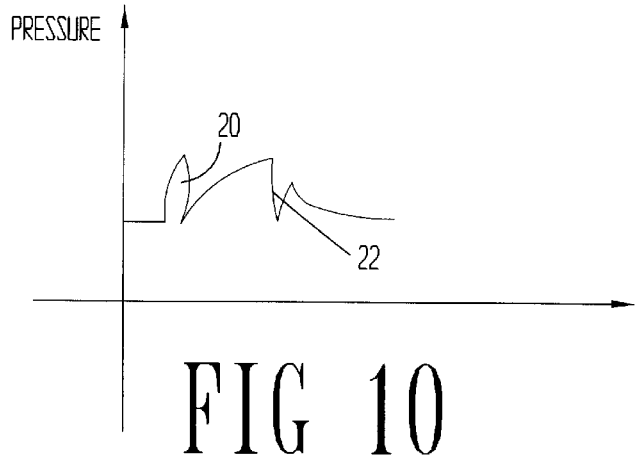
FIG. 10 is a plot of the wave form typically detected at the first transducer in actual operation.

FIG. 9 therefore represents an idealized pressure reading at transducer 46 as a single mud pressure pulse created downhole traverses the location of transducer 46. However, because of noise in the drilling system as well as the presence of the desurger 26, the pressure read by transducer 46 as a function of time is more like the wave form depicted in FIG. 10. Even the signal depicted in FIG. 10 is still somewhat idealized inasmuch as this signal will 'ride' all the other pressure fluctuations of the drilling fluid including base line pressure, mud pump noise, torque noise and bit noise. The pressure spikes idealized in FIG. 9, and more accurately represented in FIG. 10, were known to exist in the related art; however, their exact cause and the information they represent were not known. Also unknown was the disclosed telemetry methods and system.

In a drilling system designed to utilize the information represented by the interaction of the upstream traveling mud pressure pulse with its reflection pulse, placement of transducer 46 is important to obtain all the benefits of the invention. Transducer 46 preferably is placed sufficiently downstream of the reflective elements such that it can detect upstream traveling mud pressure pulses for a sufficient period of time before the upstream traveling pressure pulse reflects and interacts. Stated otherwise, transducer 46 preferably placed sufficiently downstream that a leading portion of the upstream traveling pulse is measured without interaction from a downstream traveling pulse. Further, the transducer 46 placement allows for the measurement of a trailing portion of the downstream traveling pulse after the upstream traveling pulse has passed the transducer location. It has been found that a range of possible locations for the placement of transducer 46 exists. For ideal performance, the range of placement is not less than approximately 20 feet from the mud pump and desurger, and not more than approximately 300 feet from the mud pump and desurger. Moving transducer 46 farther from the mud pump and desurger results in an extended amount of time for the transducer to read a pressure fluctuation caused by a leading portion of the upstream traveling pulse and likewise an extended amount of time for the transducer to read a trailing edge of the downstream traveling pulse after the upstream traveling pulse has past. Moving the transducer 46 downstream is roughly equivalent to increasing the time P described. For correct operation of this invention, the transducers 46 and 48 should have response times of 20 milliseconds or less. It has been found that transducers with response time of 5 milliseconds work well.

In the preferred embodiment, a second transducer 48 is placed in the drilling system. The transducer 48 is located within 20 feet, but preferably as close as possible, to the mud pump 24 and desurger 26. Just as transducer 46 measures pressure fluctuations representing pressure increases or decreases as mud pulses traverse its location, so too does transducer 48. The propagation time P indicated on FIG. 9 represents the amount of time needed for a leading portion of the upstream traveling pulse to travel a distance between the transducer 46, the reflective elements, and back to the transducer 46. Inasmuch as transducer 48 is placed as close as practical to the mud pump 24 and desurger 26, the time width of the positive and negative pressure spikes as read by transducer 48 approaches zero (the propagation time P approaches zero). Stated otherwise, the pressure fluctuations read by transducer 48 would be the summation of the upstream traveling mud pressure pulse and the downstream traveling mud pressure pulse, but because the transducer is so close to the reflective element, the propagation time in this situation approaches zero. In the idealized case, a plot of the pressure as a function of time for a pressure pulse read at transducer 48 would simply be a square pulse having amplitude B above baseline pressure X.

There are many sources of noise (pressure fluctuations) in the drilling mud of a drilling system. One of the most significant, in terms of amplitude and frequency within the frequency ranges of MWD data transmissions, is noise created by the mud pump 24. This noise originates at the mud pump and propagates downstream passing transducer 48 prior to passing transducer 46. The preferred embodiment eliminates a substantial portion of the mud pump noise from the pressure pulse detection scheme by comparing or subtracting the signal read at transducer 48 (which includes a combination of detected mud pressure pulses 'riding' upon the mud pump and other noise) with the signal read by transducer 46. As mentioned though, the mud pump noise is detected at transducer 48 before that same noise is detected at transducer 46 given the propagation time between the two transducers. Therefore, before the process of subtracting, the pressure signal detected at transducer 48 is time shifted by time delaying the signal by an amount of time it takes mud pump noise to travel the distance between transducer 48 and transducer 46. If real-time measurements are not of concern, the other signal could alternatively be shifted forward in time to align the two signals.

Figures 11A, 11B, 11C:
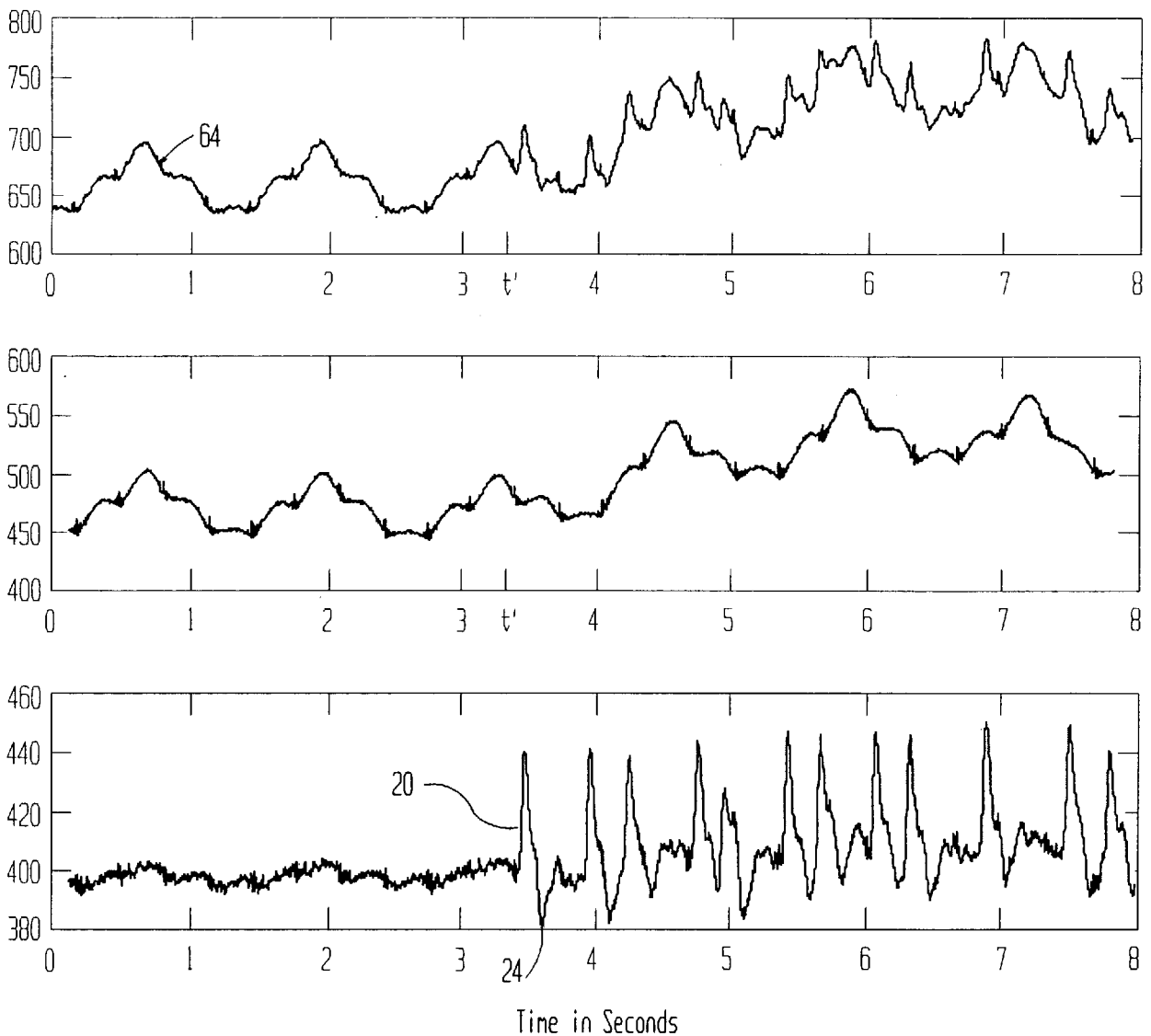
FIG. 11*a* is a plot of pressure as a function of time as detected by the first transducer in actual operation.
FIG. 11*b* is a plot of pressure as a function of time as detected by the second transducer of the preferred embodiment in actual operation.
FIG. 11*c* is a plot of pressure as a function of time of a difference signal created by the subtraction of the time shifted signal from the second transducer from the signal as detected by the first transducer.

Referring now to FIGS. 11*a*–11*c,* these figures represent signals read by drilling system transducers and a signal created by operation upon the signals detected by the transducers. More specifically, FIG. 11*a* is representative of a signal detected by transducer 46 in the drilling system described in FIG. 8. First there is indicated a repeating pattern of low pressure fluctuations representing mud pump noise 64. At the location indicated by t', the signal read by transducer 46 becomes jagged. This jagged signal represents the detection of a series of mud pulses 'riding' the combination of base pressure and the cyclic mud pump noise 64. As further indicated in FIG. 11*a,* starting approximately the point in time t', there is a general increase in the overall pressure signal. This increase in the overall pressure signal is caused by a combination of the mud pressure pulses and the smoothing effect of desurger 26. Referring again to FIG. 10, there is a single mud pressure pulse as might be detected in a drilling system in the absence of mud pump noise but with a desurger present. If it is assumed that the signal created downhole was a perfect square wave, FIG. 10 shows that because of the presence of the desurger 46 the pressure is slow to rise and then slow to fall back to baseline pressure. This is caused by the capacitive effect of the desurger 46. As data rates from downhole increase, it happens that the desurger does not allow pressure to fall back to baseline pressure before the next mud pressure pulse from downhole arrives influencing the pressure to rise again. In this instance, the overall pressure tends to rise as a series of mud pressure pulses impinge upon the desurger 46. Therefore, the general rise in pressure as indicated in FIG. 11*a* is indicative of the effect of high rates of mud pressure pulses created downhole.

Referring to FIG. 11*b,* there is a plot of pressure as a function of time as read by transducer 48 proximate to the desurger. Again this signal contains the cyclic pump noise 64 and also shows the general rise in drilling fluid pressure. It is noted however that even though transducers 46 and 48 may only be separated by as little as about 30 feet, the pressure fluctuations read by transducer 48 do not become as jagged as the pressure fluctuations read by transducer 46.

As is indicated in FIGS. 11*a* and 11*b,* and as previously mentioned, transducer 48 detects each three lobe pattern of cyclic pump noise 64 prior to the time the same pressure fluctuation is detected by transducer 46. Given the proximity of the second transducer 48 to the first transducer 46, the time delay in detecting the cyclic pump noise 64 is small but present. To eliminate pump noise and capacitive effect of desurger when trying to detect mud pressure pulses, this invention compares the pressure fluctuations detected at the first transducer 46 to the second transducer 48. However, before this comparison takes place, the pressure fluctuations sensed by transducer 48 can be time delayed by an amount of time it takes a single three lobed pressure fluctuation representing mud pump noise 64 to travel the distance between the second transducer 48 and the first transducer 46.

The time shifted pressure signal read by transducer 48 is subtracted from the pressure signal read by transducer 46.

That is, for each corresponding point in time, the time adjusted signal amplitude is subtracted from the pressure signal amplitude read by transducer 46. This subtraction process creates a difference signal which, for the signals of FIG. 11*a* and FIG. 11*b,* is represented by FIG. 11*c.* As indicated in FIG. 11*c,* after the subtraction process a series of positive pressure spikes 20 and negative pressure spikes 24 emerge. Each set of one positive pressure spike followed by a negative pressure spike represents the leading and trailing portions respectively of one drilling fluid pressure pulse created by a downhole transmitter representing information. In the situation where the transmitter 40 is an electromechanical pulser, each set of one positive and one negative pressure spike represents the closing and opening respectively of a valve poppet downhole to create the increased pressure being the mud pressure pulse. By detecting sets of pressure spikes in the difference signal rather than trying to detect the presence or absence of pulses in the midst of the significant noise found in a drilling system, data rates faster than related art devices are achievable. Data rates as fast as 10 pulses per second or faster may be achievable. One of ordinary skill in this art will realize that as transducer, data acquisition system and pulser technologies advance, even faster data rates may be achievable and still be within the scope of this invention.

The process of subtracting the signals as produced by the two transducers not only highlights sets of positive and negative pressure spikes and substantially removes mud pump noise, but also significantly reduces other noise created downhole. An example would be torque noise which has a relatively low frequency as compared to both mud pressure pulses and cyclic mud pump noise. Inasmuch as any torque noise present in the drilling system will be detected by both transducer 46 and transducer 48, the process of subtracting signals read by transducer 46 and transducer 48 will effectively eliminate torque noise from the difference signal. One of ordinary skill in the art will realize however that the time shifting to perfectly align mud pressure pulses between transducer 48 and transducer 46 is actually opposite the time shifting that would be needed to align in time noise from downhole, and specifically torque noise. However, torque noise is of such a low frequency relative to the mud pressure pulse signals that the time shift only minimally affects the ability to subtract out the presence of the torque noise and therefore such noise is effectively removed.

Figure 2A:
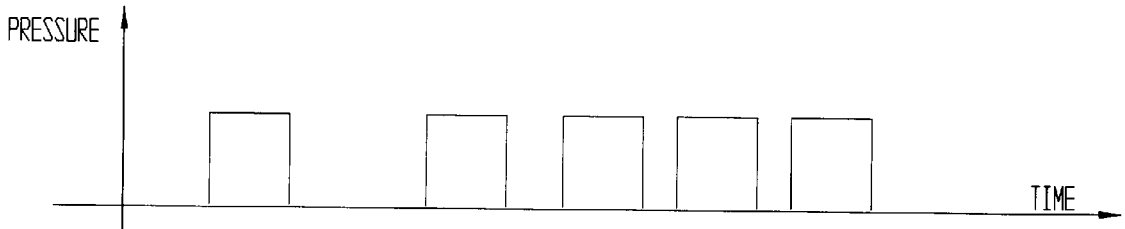
FIG. 2*a* shows an idealized set of square wave mud pressure pulses arriving at successively faster rates.
Figure 2B:
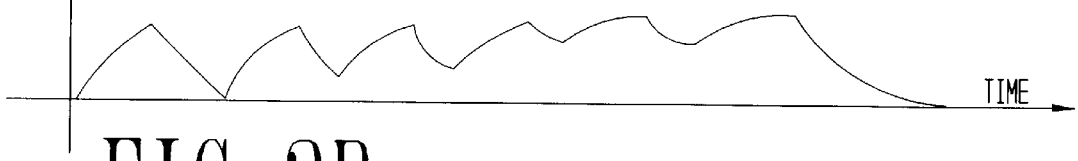
FIG. 2*b* shows an idealized plot of the dampening effect of a desuger.

Some coding schemes for detection of mud pressure pulses depend on detecting the time of arrival of successive mud pressure pulses. As data rates increase, and the respective dampening effect as described with reference to FIG. 2 increases, calculating a time of arrival becomes increasingly more difficult. Creating the difference signal as described above, however, allows for the detection of mud pressure pulses at data rates where prior systems would be unable to discern a time of arrival. Utilizing the present method, the set of pressure spikes representing leading and trailing portions of mud pressure pulses are easily detectable. That is, as the data rate in the system increases there is little or no degradation of the detectability of the positive and negative pressure spikes within the difference signal.

A data acquisition computer or signal processor 62 generates the difference signal and further deciphers or decodes the information represented by detected pulse frequency, detected pulse width, or full presence or absence of pulses, generally depending upon the type of modulation used in the particular system. For example, in a pulse position modulation system, a width of the mud pressure pulse, represented by a set of positive and negative pressure spikes, represents some piece of information.

In a second embodiment of the invention only a single transducer 46 is used to detect pressure fluctuations in the drilling fluid. In this instance, the signal created by measuring pressure fluctuations at the location of transducer 46 contains all the noise of the drilling system including bit noise, torque noise and mud pump noise. Detection of mud pressure pulses created downhole and traveling upstream in this single transducer embodiment still involves detecting sets of pressure spikes; however, by definition this single transducer embodiment does not have a second signal to subtract from the signal detected by the transducer 46 to eliminate noise. In this single transducer embodiment the signal created by measuring pressure fluctuations is applied to a bandpass filter. The bandpass, of course, would pass only those frequency spectrum components in the band of frequencies of the pressure spikes and reject unwanted noise. Drilling fluid pressure pulses have a similar frequency spectrum to that of much of the other noise in the drilling fluid, including mud pump noise, and therefore are hard to distinguish. Pressure spikes however have a frequency spectrum much higher than the mud pressure pulses. Although there may be drilling fluid system noise having a similar frequency spectrum to that of the pressure spikes, after bandpass filtering the pressure spikes are easier to distinguish from ambient noise than a mud pressure pulse would be from mud pump noise. After this bandpass filtering, pressure spikes themselves, as well as any additional noise with the frequency spectrum roughly the same as the pressure spikes, remain in a filter signal. From this filtered signal the signal processor detects sets of positive and negative pressure spikes and thereby receives and decodes telemetry as sent from downhole.

One of ordinary skill in this art will realize that time shifting the signal created by the second transducer to align pump noise with the signal created by the first transducer is actually shifting opposite the direction that would be needed to align in time the signals read between the first transducer and the second transducer with respect to detected mud pressure pulses and downhole noise. However, mud pump noise is such a significant component of the overall noise in the drilling system that time shifting to eliminate this noise provides substantial gains in the signal to noise ratio. With respect to the pressure spikes detected representing leading and trailing portions of mud pressure pulses, shifting the second transducer signal to align mud pump noise actually accentuates the pressure spike within the difference signal.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. For example, the signal processor as disclosed herein could be a digital computer, for instance a data acquisition computer. It would be possible to compare or subtract the signals produced by the first transducer 46 and the second transducer 48 using completely analog methods, and yet the same results could be achieved. One of ordinary skill in the art will realize there are multiple substantially equivalent ways to create a difference signal including, but not limited to, the subtraction process disclosed, an addition process where one signal is negative before the addition, or any other similar method. Likewise, the specification speaks of time shifting one signal to align a particular feature before the process of creating a difference signal. One of ordinary skill in the art will understand that either signal could be time shifted (by time advancing or time delaying the appropriate signal) and that the alignment need not be an alignment of mud pulse noise, but rather, could be an alignment to eliminate the predominant noise of the particular system. Accordingly, the scope of protection is not limited to the embodiments described herein, but is only limited by the claims which follow, the scope of which shall include all equivalents of the subject matter of the claims.

What is claimed is:

1. A method of detecting pressure pulses in drilling fluid during drilling operations comprising:

generating a drilling fluid pressure pulse in a drillstring downstream of one or more transducers creating an upstream traveling pulse;

reflecting said upstream traveling pulse at a location upstream of one or more transducers creating a downstream traveling reflection pulse;

detecting said drilling fluid pressure pulse by analyzing an interaction between said upstream traveling fluid pressure pulse and said reflection pulse comprising:

measuring pressure fluctuations in the drilling fluid at a first location downstream from a desurger to create a first measurement;

measuring pressure fluctuations in the drilling fluid at a second location proximate to said desurger to create a second measurement;

comparing the second measurement to the first measurement to create a difference signal; and detecting a set of pressure spikes in said difference signal.

2. The method as defined in claim 1 wherein said comparing further comprises subtracting the second measurement from the first measurement to create said difference signal.

3. The method as defined in claim 1 where said detecting a set of pressure spikes further comprises detecting said set of pressure spikes representing one mud pressure pulse in a fluid telemetry communication wherein a rising pressure spike denotes a leading edge of the fluid pressure pulse and a falling pressure spike denotes a trailing edge of the fluid pressure pulse.

4. The method as defined in claim 1 wherein measuring pressure fluctuations in the drilling fluid at the second location further comprises measuring said pressure fluctuations by attaching a pressure transducer to be in fluid communication with the drilling fluid.

5. The method as defined in claim 1 wherein measuring pressure fluctuations in the drilling fluid at the second location further comprises measuring said pressure fluctuations by attaching a pressure transducer to be in fluid communication with a gas side of said desurger.

6. The method as defined in claim 1 wherein the step of generating said fluid pressure pulse further comprises generating multiple fluid pressure pulses at a rate greater than approximately 1 pulse per second.

7. The method as defined in claim 6 further comprising generating said fluid pressure pulses at a rate of approximately 10 pulses per second.

8. The method as defined in claim 1, prior to comparing, further comprising time shifting one of said measurements.

9. The method as defined in claim 8 further comprising:

detecting pump pressure fluctuations generated by a fluid pump at said second measurement location at a first time; then detecting said pump pressure fluctuations at said first measurement location at a second time; and comparing pressure fluctuations detected at the second time to the pressure fluctuations at detected at the first time to create the difference signal.

10. The method as defined in claim 9 wherein comparing the pressure fluctuations further comprises subtracting to create said difference signal.

11. The method as defined in claim 1 wherein said measuring at a first location further comprises measuring downstream from said desurger at a location where a leading portion of the upstream traveling pulse is measured before said downstream traveling reflection pulse interacts with said upstream traveling pulse.

12. The method as defined in claim 11 further comprising measuring at said first location with said first location being greater than approximately 20 feet from said desurger.

13. The method as defined in claim 11 further comprising measuring at said first location with said first location being not more than approximately 300 feet from said desurger.

14. The method as defined in claim 1 wherein said detection of said fluid pressure pulse further comprises:

measuring pressure fluctuations in the drilling fluid at a meant location downstream from a desurger;

filtering said measurement as a function of frequency within a band of frequencies to create a filtered signal;

detecting a set of pressure spikes in said filtered signal representing data in a fluid telemetry communication wherein a rising pressure spike denotes a leading portion of the fluid pressure pulse and a falling pressure spike denotes a trailing portion of the fluid pressure pulse.

15. The method as defined in claim 14 further comprising measuring at said measurement location with said location being approximately 20 feet from said desurger.

16. The method as defined in claim 14 further comprising measuring at said measurement location with said location being not more than approximately 300 feet from said desurger.

17. A structure of a telemetry system, said structure comprising:

a mud pump fluidly connected to a drillstring to pump drilling fluid downstream within said drillstring;

a downstream system within said drillstring to create a fluid pressure pulse traveling upstream;

a desurger proximate to said mud pump fluidly connected to said drilling fluid to smooth pressure fluctuations in the drilling fluid;

a first transducer to detect said fluid pressure pulse downstream of said fluid pump, said first transducer creating a first measurement;

a second transducer to detect said fluid pressure pulse proximate to the desurger, said second transducer creating a second measurement;

a signal processor to receive said first and second measurements, said signal processor detecting said fluid pressure pulse by analyzing an interaction between said upstream traveling fluid pressure pulse and a downstream traveling reflection pulse created by reflection of the upstream traveling fluid pressure pulse, and wherein said signal processor analyzes said interaction by comparing the second measurement to the first measurement to create a difference signal having a set of pressure spikes.

18. The structure as defined in claim 17 wherein said pressure spikes represent data in a fluid telemetry communication with a rising pressure spike representing a leading edge of the fluid pressure pulse and a falling pressure spike representing a trailing edge of the fluid pressure pulse.

19. The structure as defined in claim 17 wherein the comparing further comprises subtracting the second measurement from the first measurement to create the difference signal.

20. The structure as defined in claim 17 wherein said signal processor further comprises a data acquisition computer.

21. The structure as defined in claim 17 wherein said second transducer is in fluid communication with the drilling fluid.

22. The structure as defined in claim 17 where said second transducer is in fluid communication with a gas side of said desurger.

23. The structure as defined in claim 17 wherein said signal processor time delays said second measurement by adding an amount of time required for a pressure fluctuation created by the mud pump and detected by the second transducer to reach the first transducer before the step of comparing to create the difference signal.

24. The structure as defined in claim 23 wherein the comparing further comprises subtracting the second measurement from the first measurement to create the difference signal.

25. The structure as defined in claim 17 wherein said first transducer is located downstream of the desurger such that a leading portion of said upstream traveling fluid pressure pulse is measured before a reflected downstream traveling pulse interacts with said upstream traveling pulse.

26. The structure as defined in claim 25 wherein said first transducer is positioned more than approximately 20 feet from said desurger.

27. The structure as defined in claim 25 wherein said first transducer is positioned not more approximately 300 feet from said desurger.

28. A telemetry system, comprising:

a mud pump fluidly connected to a drillstring to pump drilling fluid downstream within the drillstring;

a downstream system within said drillstring to create a fluid pressure pulse traveling upstream;

a desurger proximate to said mud pump fluidly connected to said drilling fluid, said desurger to smooth pressure fluctuations in the drilling fluid;

a first transducer to detect said fluid pressure pulse downstream of said fluid pump, said first transducer creating a first measurement;

a signal processor that receives the first measurement and detects the fluid pressure pulse by analyzing an interference pattern between said upstream traveling fluid pressure pulse and a downstream traveling reflection pulse created by reflection of the upstream traveling fluid pressure pulse, and wherein said signal processor bandpass filters said first measurement to create a filtered signal and detects the fluid pressure pulse by analyzing the interference pattern within the filtered signal to detect a set of pressures spikes.

29. The telemetry system of claim 28 wherein said pressure spikes represent data in a fluid telemetry communication with a rising pressure spike representing a leading edge of the fluid pressure pulse and a falling pressure spike representing a trailing edge of the fluid pressure pulse.

30. The telemetry system of claim 28 further comprising:

a second transducer proximate to said desurger to detect the fluid pressure pulse and to create a second measurement; and said signal processor receives said second measurement and analyzes said interference by comparing the second measurement to the first measurement to create a difference signal having a set of pressure spikes.

31. The telemetry system of claim 30 wherein said pressure spikes represent data in a fluid telemetry communication with a rising pressure spike representing a leading edge of the fluid pressure pulse and a falling pressure spike representing a trailing edge of the fluid pressure pulse.

* * * * *